US006149790A

United States Patent [19]

Oikawa et al.

[11] Patent Number: 6,149,790

[45] Date of Patent: Nov. 21, 2000

[54] METHOD OF MAKING IRON-ELECTROPLATED ALUMINUM MATERIALS

[75] Inventors: Wataru Oikawa, Nasugun; Eiichi Takeuchi, Fujisawashi, both of Japan

[73] Assignee: Nippon Platec, K.K.

[21] Appl. No.: 09/097,030

[22] Filed: Jun. 12, 1998

[30] Foreign Application Priority Data

Jul. 4, 1997 [JP] Japan ..... 9-215396
Jul. 9, 1997 [JP] Japan ..... 9-218889

[51] Int. Cl.[7] ..... C23C 28/00; C25D 5/50

[52] U.S. Cl. ..... 205/113; 205/153; 205/196; 205/228; 205/255

[58] Field of Search ..... 205/50, 113, 139, 205/153, 196, 213, 227, 228, 255

[56] References Cited

U.S. PATENT DOCUMENTS

| | | | |
|---|---|---|---|
| 1,256,954 | 2/1918 | Travers | 205/228 |
| 4,094,749 | 6/1978 | Stange et al. | 205/113 |
| 4,221,639 | 9/1980 | Ninagawa et al. | 428/624 |
| 4,388,379 | 6/1983 | Klingenmaier | 428/613 |
| 4,655,884 | 4/1987 | Hills | 205/181 |
| 5,368,719 | 11/1994 | Troup-Packman | 205/213 |
| 5,516,419 | 5/1996 | Phan et al. | 205/148 |

*Primary Examiner*—Kathryn Gorgos
*Assistant Examiner*—William T. Leader
*Attorney, Agent, or Firm*—Shlesinger Fitzsimmons Shlesinger

[57] ABSTRACT

A method for making an aluminium material which is electroplated on its aluminum or aluminium alloy base with iron or an iron alloy containing 2–20 weight % of chromium, and which can be utilized as a new structural or functional material in various industrial fields. The material is characterized in having an inter-diffusion layer produced between the base and the plating and/or having such fine cracks produced in the plating which can reserve well machine oil, work well for painting it, and be impregnated with a resin for improving its wear resistance and so on.

5 Claims, 1 Drawing Sheet

METHOD OF MAKING IRON-ELECTROPLATED ALUMINUM MATERIALS

BACKGROUND OF THE INVENTION

This invention relates to a novel method of making iron-electroplated aluminium or aluminium alloy materials, by which a selected or whole part of surfaces of aluminium or aluminium alloy in the form of a sheet for example is firmly electroplated by iron or iron alloy.

The materials made by this invention can widely be employed in various industries including an automobile industry and electric appliance industry. For example, in the automobile industry, there is every indication that aluminium and aluminium alloys will be employed as much as possible in order to lighten automobiles, while aluminium or aluminium alloys as they are can hardly be structural materials for automobiles.

In this view, aluminium or aluminium alloys, surfaces of which are iron-electroplated, have drawn our attention, because as they have advantageous features such as good spot-weldability, they could be structural materials for automobiles.

However, an iron layer which has been conventionally electroplated to aluminium or aluminium alloy surfaces, peels off occasionally.

It is therefore an object of this invention to provide a method of making iron-electroplated aluminium or aluminium alloy materials, plated iron layer of which can hardly peel off from its aluminium or aluminium alloy base, or can hardly cleave or fissure.

It is another object of this invention to provide a method of making iron-electroplated aluminium or aluminium alloy materials, electroplated iron layer of which can stand well against frictional and other wears.

Other objects of this invention will be apparent hereinunder from the specification and from the recital of the appended claims.

SUMMARY OF THE INVENTION

In this invention, after surfaces of aluminium or an aluminium alloy were electroplated by iron, they are subjected to a heat-treatment of a temperature between about 450 and 650° C., whereby an inter-diffusion layer of Al and Fe is produced at the boundary area of the aluminium or aluminium alloy base and the iron-electroplated layer on the base. The inter-diffusion layer enhances the adhesion of the iron plating with the aluminium base, and works to prevent the iron plating to peel off from the aluminium base or to cleave or fissure. This is a characteristic feature of this invention.

The aluminium or aluminium alloy material which has been heat-treated as described above, has to be cooled. When the material is quenched rapidly at a cooling speed of 60° C./minute for example, fine cracks are produced evenly all over the surfaces of iron plating. This is another characteristic feature of this invention. Paints adhere very well to the aluminium or aluminium alloy material having such cracks on its surfaces. It will be noted in this connection that conventional zinc plated steel sheets for automobiles are necessarily coated at their surfaces by zinc phosphate films, so that paints can adhere well to them. The aluminium or aluminium alloy material of this invention does not need such coating for the sake of painting.

When the heat-treated material is gradually cooled, instead of being rapidly quenched, at a cooling speed of 5–10° C./minute for example, cracks will not be produced on surfaces of the material, resulting in providing the material with smooth electroplated surfaces. This kind of material which is also within the scope of this invention, can advantageously be employed in an electric appliance industry as light weight magnetic shielding materials and so on.

The aluminium material made in accordance with this invention can be lubricated well, since its electroplated and cracked surfaces can reserve machine oil well, and can accordingly be excellent in wear resistance.

Iron plated and finely cracked surfaces of the aluminium material of this invention may also be coated by thermoplastic resins such as PTFE and nylon so that they can be excellent in anti-wear characteristics. When the surfaces are dipped in a molten thermoplastic resin, a part of the resin sinks into the surface cracks and solidifies in them at a room temperature. As such resin which has sunk and solidified in the surface cracks, works as roots of other part of the resin which has solidified over the surfaces, the resin applied to the material can adhere as a whole to the material firmly. When the iron electroplated aluminium material of this invention thus coated with a thermoplastic resin is subjected to sliding friction, for example, the resin becomes liquid by a frictional heat and works as a lubricant.

Iron electroplated and cracked surfaces of the aluminium material of this invention may also be coated by a thermosetting resin which has been dissolved by an organic solvent and mixed with lubricating solid particles of such fineness corresponding to or less than widths of the surface cracks. The resin coat is heated, whereby the solvent is evaporated and the thermosetting resin is solidified so that the lubricating particles are fixed to the plated surfaces and cracks thereof by means of the solidified resin. Particularly, those resin and lubricating particles which have been adhered to the cracks, work as roots of the resin coating, similarly to the above-mentioned thermoplastic resin coating.

Iron to be electroplated to aluminium or aluminium alloys in accordance with this invention may be an iron alloy, especially the iron alloy viz., a steel containing Cr of 2–20 weight % and having a hardness of 800–1,200 HV. When this steel is electroplated to aluminium or aluminium alloy, cracks are inevitably produced on plated surfaces. If desired to enlarge the cracks, the iron plated material shall be quenched rapidly after having it heat-treated in accordance with this invention, while if desired to keep the cracks as they are, the plated material shall be gradually cooled after the heat-treatment for producing an inter-diffusion layer between the aluminium substrate and the plating.

THE DRAWINGS

FIG. 1 is a graph showing results, namely relative wear volumes under various friction velocities, of sliding wear tests of the iron-electroplated aluminium material obtained in accordance with this invention in the following Example 3 and a comparative test material.

DETAILED DESCRIPTION OF THE PREFERRED EMBODIMENTS

EXAMPLE 1

Figure 1:
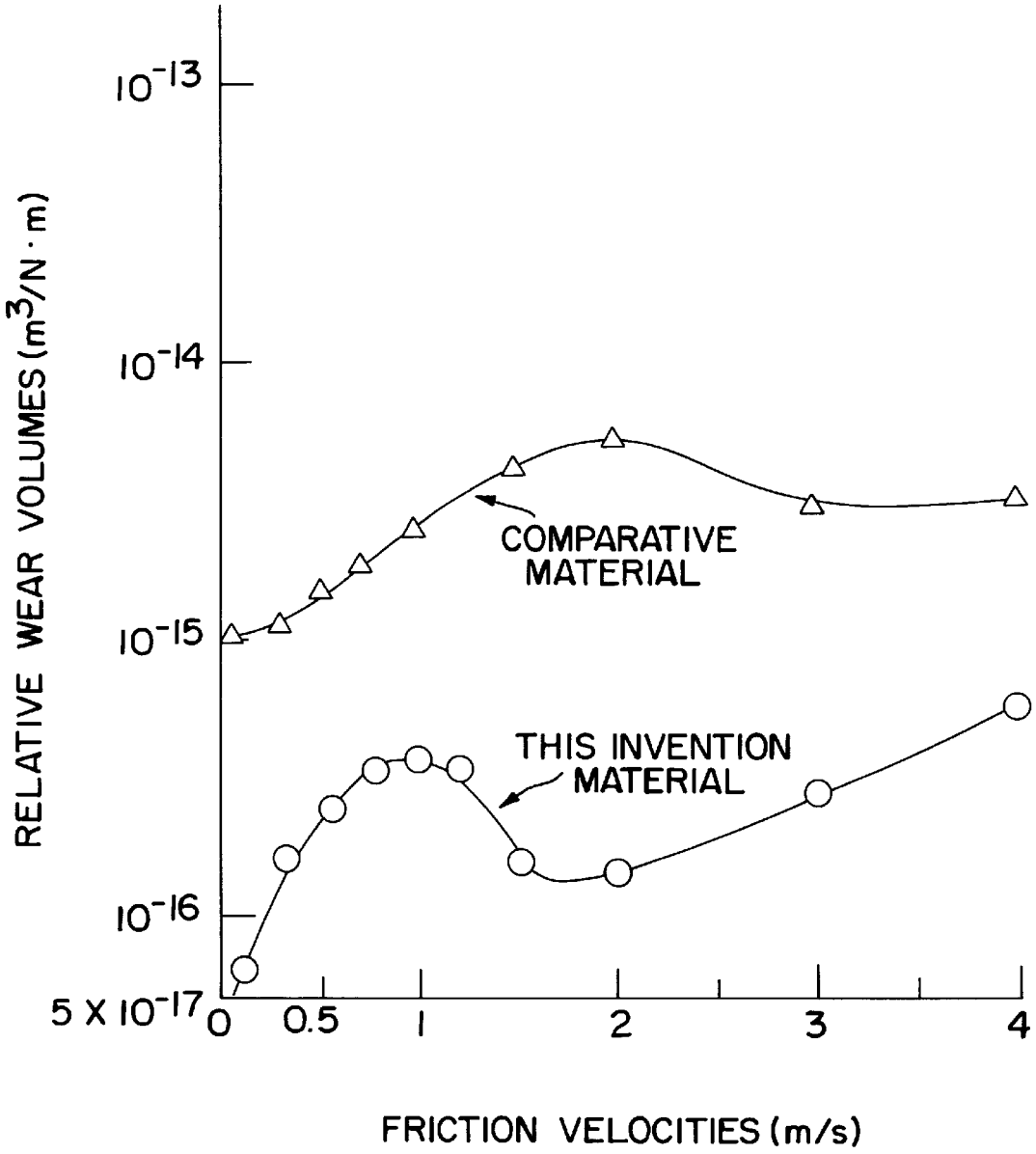

After pretreatments (comprising degreasing, acidic activation, alkaline etching, acidic activation, 1st substitution with zinc, dipping into nitric acid, 2nd substitution with zinc, and so on, while water-washing steps in the pretreatments being omitted), a rolled sheet of aluminium alloy JIS 5052) of 2 mm in thickness was electroplated in 10 $\mu$m in thickness at its outer surfaces by iron under the following electroplating conditions.

| Compositions of plating bath: | |
|---|---|
| ferrous chloride | 300 g/l |
| ammonium chloride | 20 g/l |
| Bath temperature: | 50–55° C. |
| Current density at cathode: | 6A/dm$^2$ |
| Current efficiency at cathode: | 95–100% |
| Electroplated iron films had a hardness of about 399 HV. | |

After water-washing and drying the aluminium alloy sheet thus electroplated by iron, the sheet was heated at 570° C. for five hours in an inert atmosphere of $N_2$ gas under a pressure of 2 bar, and quenched in a similar atmosphere rapidly at a cooling speed of 60° C./minute.

Tortoiseshell-like patterned fine cracks which were produced evenly almost all over the iron plate, were observed by scanning with an electron microscope.

The same aluminium sheet was iron-electroplated and heat-treated under the same conditions, but was cooled gradually at a cooling speed of 5° C./minute. No crack was observed at the iron plate.

By the observation through an optical microscope and EPMA of the above-described two kinds of iron-electroplated aluminium alloy materials thus obtained, it was confirmed that inter-diffusion layers of Al and Fe had been produced along boundary areas of the aluminium alloy base and iron plate. It was also observed that they had adhered closely and firmly to each other. They never cleaved even by 90° bending test.

EXAMPLE 2

Rolled sheets of 2 mm in thickness of aluminium alloy JIS 5052) were pretreated similarly to Example 1, and an iron alloy containing about 15 weight % of Cr was electroplated in thickness of 10 $\mu$m on the outer surfaces of sheets under the following conditions.

| | | |
|---|---|---|
| Bath compositions: | trichrome-plus made by Atotech Japan Co. as a basic composition, added by 40 g/l of ferrous sulfate. trichrome-plus having the compositions correspondent to those for trivalent chronium plating, and consisting of: | |
| | basic chromium sulfate (tanning agent) | 120 g/l |
| | ammonium formate | 55 g/l |
| | ammonium oxalate | 10 g/l |
| | potassium chloride | 54 g/l |
| | ammonium chloride | 54 g/l |
| | boric acid | 40 g/l |
| Bath temperature: | 30° C. | |
| Cathode: | made of insoluble carbon | |
| Current density: | 15 A/dm$^2$ for first 5 minutes, and 10 A/dm$^2$ for succeeding 18 minutes | |

The iron-chromium alloy films electroplated on the sheets had a hardness of about 800 HV. It was observed by an electron microscope that over the films, there were produced tortoise-shell-like patterned fine cracks.

After water-washing and drying the sheets thus electroplated by the iron-chromium alloy, they were heated to 570° C. for 5 hours in an inert atmosphere of $N_2$ gas under a pressure of 2 bar, and succeedingly quenched in the similar atmosphere rapidly at a cooling speed of 60° C./minute. It was observed that cracks on the plated surfaces had grown further.

On the other hand, when the sheets were cooled gradually at a cooling speed of 5° C., the cracks on the plated surfaces did not change.

It was found by the observation through an optical microscope and EPMA of vertically cut-out sectional structures of the above-described two kinds of plated aluminium sheets that inter-diffusion layers had been produced along boundary areas between the Al base and Fe plating, and that they had adhered closely and firmly to each other. They were never cleaved or fissured when subjected to 90° bending tests.

EXAMPLE 3

To surface cracks of the aluminium alloy sheets of Example 2 which had been electroplated by the Fe—Cr alloy but not been heat-treated, Nylon 11 was impregnated under pressure, and the surfaces were coated by films of said thermoplastic resin.

The sheets thus impregnated and coated by the resin were made as stationary test pieces, while S45C of a sorbite structure (HQT) was made as rotary test pieces. With these stationary and rotary test pieces, the sheets were subjected to sliding wear tests, in which a pin-ring type wearing test machine was employed, and their contact pressure was kept at 0.49 MPa.

The results are shown in FIG. 1 by a curve of THIS INVENTION MATERIAL.

For the sake of comparison, the same aluminium sheets of Example 2 were electroplated by iron, and nitrided by a gas permeation process for hardening the iron plating. After having been nitrided, this comparative test sheets were gradually cooled at a cooling speed of 5° C./minute. As the sheets had no cracks on their plated surfaces, no coating was applied on them.

The comparative test sheets were also subjected to the aforementioned sliding wear tests, results of which are shown in FIG. 1 by a curve of THE COMPARATIVE MATERIAL. Although the comparative material had a harder plated surface than this invention material, the latter showed smaller relative wear volumes than the former.

EXAMPLE 4

To surface cracks of the aluminium alloy sheets of Example 2 which had been electroplated by the Fe—Cr alloy but not been heat-treated, an epoxy resin, a thermosetting resin which had been dissolved by an organic solvent and mixed well with lubricating MoS2 particles having a particle size nearly equal to or less than widths of the cracks, was coated, and then heated to about 150° C. for evaporating the solvent and for solidifying the resin.

The resin with the lubricating solid particles which sunk into the cracks and solidified therein, became such roots which were in turn connected to the resin coating and worked to prevent it to peel off from the plated surface.

The aluminium material thus obtained in this Example showed a good wear resistance which is comparable to this invention material of Example 3.

What is claimed is:

1. Method for making aluminum or aluminum alloy material electroplated with an iron alloy containing 2–20 weight % of chromium, which comprises:

electroplating the material with the iron alloy containing 2–20 weight % of chromium to form an electroplated surface with cracks then, heat-treating the electroplated material at a temperature between about 450 and about 650° C., producing an inter-diffusion layer at a boundary area between a surface of the material and the iron alloy electroplated on the surface, and succeedingly cooling the electroplated material.

2. The method as claimed in claim 1, in which the cooling of the electroplated material is conducted at a cooling speed of more than about 60° C. per minute to effect growing of said cracks.

3. The method as claimed in claim 1, in which the cooling of the electroplated material is conducted at a cooling speed of more than 5° C. per minute and less than about 60° C. per minute to maintain the cracks as they are.

4. Method for making an aluminum or aluminum alloy material electroplated with an iron alloy containing 2–20 weight % of chromium, which comprises;

electroplating the material with the iron alloy containing 2–20 weight % of chromium to form an electroplated surface with cracks, and applying to the electroplated surface a thermoplastic resin for coating said surface of the material and impregnating the cracks therein.

5. Method for making an aluminum or aluminum alloy material electroplated with an iron alloy containing 2–20 weight % of chromium, which comprises;

electroplating the material with the iron alloy containing 2–20 weight % of chromium to form an electroplated surface with cracks, and applying to and coating the electroplated surface with a thermosetting resin mixed with lubricating solid particles for impregnating the cracks in said surface.

* * * * *